US008718528B2

(12) United States Patent
Zhang et al.

(10) Patent No.: US 8,718,528 B2
(45) Date of Patent: May 6, 2014

(54) EFFICIENT FUSING AND FIXING FOR TONERS COMPRISING OPTO-THERMAL ELEMENTS

(75) Inventors: Yuanjia Zhang, Rochester, NY (US); Mandakini Kanungo, Penfield, NY (US); Samir Kumar, Pittsford, NY (US); Faming Li, Solon, OH (US)

(73) Assignee: Xerox Corporation, Norwalk, CT (US)

( * ) Notice: Subject to any disclaimer, the term of this patent is extended or adjusted under 35 U.S.C. 154(b) by 129 days.

(21) Appl. No.: 13/352,105

(22) Filed: Jan. 17, 2012

(65) Prior Publication Data

US 2013/0183073 A1 Jul. 18, 2013

(51) Int. Cl.
*G03G 15/20* (2006.01)

(52) U.S. Cl.
USPC ..... 399/336; 399/27

(58) Field of Classification Search
USPC ..... 399/336
See application file for complete search history.

(56) References Cited

U.S. PATENT DOCUMENTS

| | | | | |
|---|---|---|---|---|
| 4,897,691 | A * | 1/1990 | Dyer et al. | 399/156 |
| 7,452,645 | B2 * | 11/2008 | Sugiura | 430/108.1 |
| 7,495,599 | B2 | 2/2009 | Andersson et al. | |
| 7,682,542 | B2 * | 3/2010 | Chen et al. | 264/235 |
| 7,745,080 | B2 * | 6/2010 | Nakamura et al. | 430/45.51 |
| 7,754,408 | B2 | 7/2010 | Kumar et al. | |
| 7,851,111 | B2 | 12/2010 | Hays et al. | |
| 2008/0101804 | A1 * | 5/2008 | Yoda et al. | 399/21 |
| 2008/0101832 | A1 * | 5/2008 | Yaoi et al. | 399/336 |
| 2009/0297234 | A1 * | 12/2009 | Cahill | 399/327 |
| 2010/0104332 | A1 * | 4/2010 | Law et al. | 399/328 |
| 2010/0124713 | A1 * | 5/2010 | Farrugia et al. | 430/108.1 |

* cited by examiner

*Primary Examiner* — Clayton E Laballe
*Assistant Examiner* — Jas Sanghera
(74) *Attorney, Agent, or Firm* — MH2 Technology Law Group LLP

(57) ABSTRACT

Various embodiments provide materials, apparatus, and methods for forming an image. Exemplary imaging apparatus can include one or more light sources configured to treat toner images after they are transferred on an image receiving substrate (e.g., a copy sheet). The toner images can be formed of an opto-thermal toner containing opto-thermal elements in a toner composition. The fuser subsystem may or may not be configured in the disclosed imaging apparatus.

20 Claims, 5 Drawing Sheets

EFFICIENT FUSING AND FIXING FOR TONERS COMPRISING OPTO-THERMAL ELEMENTS

DETAILED DESCRIPTION

Background

In a typical electrostatographic reproducing apparatus, a light image of an original to be copied can be recorded in the form of an electrostatic latent image upon an imaging receiving member and the latent image can be subsequently rendered visible by the application of electroscopic thermoplastic resin particles, commonly referred to as toner.

FIG. 1 depicts a conventional imaging apparatus, where an imaging receiving member 110 such as a photosensitive member or a photoreceptor can be charged on its surface by means of a charger 112 to which a voltage can be supplied from a power supply 111. The imaging receiving member 110 can then be image-wise exposed to light from an optical system or an image input apparatus 113 to form an electrostatic latent image thereon. Generally, the electrostatic latent image can be developed by bringing a developer mixture from developer station 114 into contact therewith. Development can be effected by use of a magnetic brush, powder cloud, or other known development process.

After the toner particles have been deposited on surface of the imaging receiving member 110, they can be transferred to an image receiving substrate 116 such as a copy sheet by a transfer means 125, which can be pressure transfer or electrostatic transfer. Alternatively, the developed image can be transferred to an intermediate transfer member and subsequently transferred to a copy sheet. After the transfer of the toner image is completed, the image receiving substrate 116 can advance to fusing subsystem 119 including a fusing member 120 and a pressure member 121, wherein the toner image is fused to the image receiving substrate 116 by passing the image receiving substrate 116 between the fusing member 120 and pressure member 121, thereby forming a permanent image. The imaging receiving member 110, subsequent to transfer, can advance to a cleaning station 117, wherein any toner left on the imaging receiving member 110 is cleaned there-from by use of a blade 122, brush, or other cleaning apparatus.

Problem arises, however, due to low energy efficiency of the contact fusing subsystem (see 119 in FIG. 1). In most xerographic printers, fuser consumes over 50% of the total machine energy while less than 10% of the fuser energy is used for the fusing process. This is because the heat needed to melt toner is transferred from fuser/pressure members, while toner materials cannot be actively heated. For fusing systems, energy is wasted in warming up paper and heating the fuser/pressure members during operation and standby. Additionally, when release agent is applied for effective release of toner images from the fuser member, chemical reactions often occur between the toner materials and release agents under high temperature and pressure that are conventionally used. This leads to low energy efficiency, print defects, and limited life time of fuser members.

Conventional non-contact fusing systems include radiant and flash fusing systems. Problems still arise, however, because radiant fusing can heat paper up to its burning point and take a long time to cool down, generating safety concerns, energy inefficiency and high sensitivity to temperature control. A flash fusing system results in little paper heating and requires lower power. But the pulsed heater is expensive. Furthermore, the heating highly depends on toner absorptivity. For example, black toner heats up much more efficiently than color toners. So the toner formulation requires tailoring for equivalent heating with different pigments.

Thus there is still a need for apparatus and methods for an efficient fusing that is fast, safe, less expensive, energy efficient and less demanding in color-dependent formulation tailoring.

SUMMARY

According to various embodiments, an apparatus for forming an image is provided. The apparatus for forming an image can include an image receiving member comprising a toner image deposited thereon, wherein the toner image comprises one or more opto-thermal elements incorporated with a polymer. It can further include an intermediate transfer member for transferring the toner image from the image receiving member to an image receiving substrate and one or more light sources configured in proximity to the toner image comprising the one or more opto-thermal elements to optically induce the one or more opto-thermal elements to heat the toner image on the image receiving substrate.

According to various other embodiments, a method of forming an image is provided. The method can include incorporating one or more opto-thermal elements into a toner composition to form an opto-thermal toner and depositing the opto-thermal toner on an image receiving member to form a toner image. The method can further include transferring the toner image from the image receiving member to an image receiving substrate and exposing the one or more opto-thermal elements in the toner image to an optical signal to generate heat to fix the toner image on the image receiving substrate.

According to various other embodiments, another method of forming an image is provided. The method can include depositing a toner image on an image receiving member; the toner image comprising one or more opto-thermal elements and transferring the toner image from the image receiving member to an image receiving substrate. The method can further include exposing the one or more opto-thermal elements in the toner image to an optical signal to heat the toner image on the image receiving substrate and passing the image receiving substrate through a contact arc formed by a fuser member and a pressure member to fix the toner image on the image receiving substrate.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

DESCRIPTION OF THE EMBODIMENTS

Figure 1:
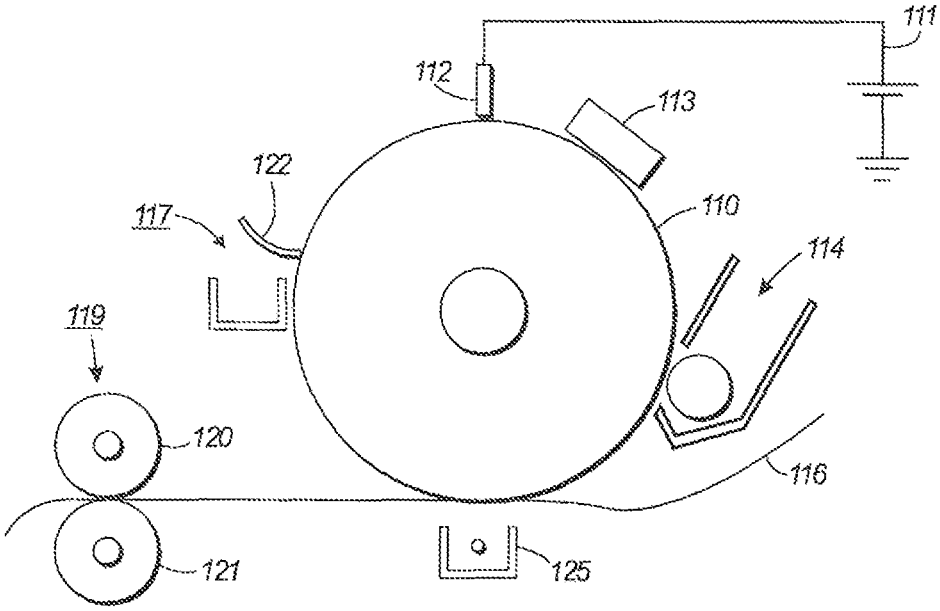
FIG. 1 (Prior Art)
FIG. 1 depicts a conventional imaging apparatus.

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. The following description is, therefore, merely exemplary.

Various embodiments provide materials, apparatus, and methods for forming an image. Exemplary imaging apparatus can include one or more light sources configured to treat toner images after they are transferred on an image receiving substrate (e.g., a copy sheet). The toner images can be formed of an opto-thermal toner containing opto-thermal elements in a toner composition.

As used herein, unless otherwise specified, the term "opto-thermal elements" refers to elements capable of exhibiting a thermal behavior in response to an optical signal or exhibiting an optical behavior in response to a thermal signal. For example, the opto-thermal elements can generate heat in response to exposure or illumination of light. The opto-thermal elements can include light induced heating elements. In one embodiment, the light induced heating elements can include those described in U.S. patent application Ser. No. 12/257,015, entitled "Nanomaterial Heating Element for Fusing Applications," which is commonly assigned to Xerox Corp., and incorporated by reference in its entirety herein.

As used herein, unless otherwise specified, the term "opto-thermal toner" refers to a toner or toner composition including opto-thermal elements. In this specification and the claims that follow, "toner" can be referred to as "toner composition" and vice versa. The toner can be any known toner including, for example, emulsion/aggregation (EA) toner, liquid toner, or other suitable toner composition. The toner can include polymer(s), e.g., known as toner resins.

The opto-thermal elements can be incorporated with polymers in the toner composition such that the opto-thermal elements can be exposed to or otherwise receive an optical signal (e.g., from a light illumination). For example, the polymers can be optically transparent to the optical signal. Alternatively, regardless of the optical transparency of the polymers in the toner, the opto-thermal elements can be at least partially exposed to the surface of the toner.

Polymers in a toner can include, for example, crystalline polymer, semi-crystalline polymer, and/or amorphous polymer. Specifically, the polymers in toner can include polycarbonates, polyamides, polyesters and polyurethanes, the polyamide of adipic acid and hexamethylene diamine (nylon 6,6), poly(6-aminohexanoic acid) (nylon-6), the polyamide of meta-phthalic acid and meta-diaminobenzene (Nomex), the polyamide of para-phthalic acid and para-diaminobenzene (Kevlar), the polyester of dimethyl terephthalate and ethylene glycol (Dacron), the polycarbonate of carbonic acid, the polycarbonate of diethyl carbonate and bisphenol A (Lexan), the polyurethane of carbamic acid, the polyurethane of isocyanate and alcohol, the polyurethane of phenyl isocyanate with ethanol, the polyurethane of toluene diisocyanate and ethylene glycol. In embodiments, the disclosed polymers and toner composition can include those disclosed in U.S. patent application Ser. No. 12/272,412, entitled "Toners Including Carbon Nanotubes Dispersed in a Polymer Matrix", which is commonly assigned to Xerox Corp. and incorporated by reference in its entirety herein.

As used herein the term "optically transparent polymers" refers to polymers optically transparent to an extent that does not affect opto-thermal effect of the opto-thermal elements that are incorporated therewith. For example, the optically transparent polymers can have from about 10% to about 100% transparency, or from about 10% to about 60% transparency, or from about 30% to about 90% transparency in the absorption range of the opto-thermal elements.

Exemplary optically transparent polymers can include, but are not limited to, polycarbonate, PET, PMMA, nanocomposite polymers and conducting polymers like polythiophene and polyaniline and its derivatives.

The opto-thermal elements can be physically dispersed in and/or chemically bonded to the toner resins. As used herein, the opto-thermal elements being "bonded" to the toner resins refers to chemical bonding such as ionic or covalent bonding, and not to weaker bonding mechanisms such as hydrogen bonding or physical entrapment of molecules that may occur when two chemical species are in close proximity to each other. The physical dispersing can include processes of, e.g., extrusion, melt spinning or melt blowing, while the chemical bonding can include, e.g., in situ polymerization by functionalization of opto-thermal elements. In one embodiment, the opto-thermal elements can be simply mixed or dispersed in the polymeric material, but is not chemically bonded to (such as being crosslinked with) the polymer material. In another embodiment, the opto-thermal elements can be chemically bonded to the polymer material, such as being crosslinked with the polymer material. In still another embodiment, the opto-thermal elements can have a portion that are simply mixed or dispersed in the polymeric material, while other portions are chemically bonded to the polymer material.

In embodiments, the opto-thermal elements can be incorporated with polymers in a toner in an amount to allow for related toner images at least partially heated, fused, and/or fixed on an image receiving substrate, wherein a fuser subsystem may or may not be used in the imaging apparatus. Additionally, the amount of opto-thermal elements can be sufficiently low without affecting toner colors. In embodiments, the opto-thermal elements can be present in an amount ranging from about 0.1% to about 60%, or from about 0.1% to about 10%, or from about 10% to about 60% by weight, relative to a total of polymer(s) in the toner. In embodiments, the opto-thermal elements can have a density ranging from about 0.01 g/cm$^3$ to about 10 g/cm$^3$; or from about 0.01 g/cm$^3$ to about 1 g/cm$^3$, or from about 1 g/cm$^3$ to about 10 g/cm$^3$.

Upon exposure of light by one or more light source(s), the opto-thermal elements can achieve at least a local temperature in a range of about 50° C. to about 1500° C., or from about 50° to about 500° C., or from about 0.500° to about 1500° C. and can go to a desired lower temperature rapidly upon removal of the light exposure. This temperature can locally heat/fuse the toner but not the underlying image receiving substrate (e.g., a copy sheet). The time taken to reach desired temperature and to return to ambient temperature can depend on several factors, such as, for example, light source, opto-thermal element, spectral power distribution of the light source, intensity of the light source, loading, density, of the opto-thermal element, and process speed.

In embodiments, the opto-thermal elements can be in any shape and/or dimensions. For example, the opto-thermal elements can have various cross sectional shapes, such as, for example, rectangular, polygonal, oval, or circular shapes. The opto-thermal elements can be nanoparticles having an average particle size ranging from about <(less than) 1 nm to about 500 nm, or from about <1 nm to about 50 nm, or from about 50 nm to about 500 nm. The nanoparticles can have an average aspect ratio ranging from about 1 to about $10^8$:1, or from about 10:1 to about $10^7$:1, or from about 100:1 to about $10^6$:1.

The opto-thermal elements can include nano-materials, such as, for example, carbon nanotubes (CNTs), graphene, metal nanoshells, metal nanostructures, and/or their combinations.

As used herein, the term "carbon nanotubes" can be considered as one atom thick layers of graphite, called graphene sheets, rolled up into nanometer-sized cylinders, tubes or other shapes. Exemplary carbon nanotubes can include single wall carbon nanotubes (SWNTs), double wall carbon nanotubes (DWNTs), and multiple wall carbon nanotubes (MWNTs), and/or their various functionalized and derivatized fibril forms such as nanofibers. The term "carbon nanotubes" can include modified CNTs from all possible nanotubes described there above and their combinations. The modification of the nanotubes can include a physical and/or a chemical modification. For example, the carbon nanotubes may be functionalized with one or more chemical moieties. The chemical moiety on the carbon nanotubes can generally covalently attach to a suitable monomer. The monomers then polymerize by any suitable means known in the art, thereby forming carbon nanotubes dispersed in a polymer matrix. This carbon nanotube/polymer composite resin can be incorporated into a toner.

The carbon nanotubes (CNTs) can be semiconducting carbon nanotubes and/or metallic carbon nanotubes. In embodiments, the CNTs can have a weight loading of about 5% or less, e.g., ranging from about 0.1% to about 30%, or from about 0.1 to about 10%, or from about 1 to about 30%, relative to a total of polymers in toner.

The carbon nanotubes can be of different lengths, diameters, and/or chiralities. For example, the CNTs can have an average diameter ranging from about 0.1 nm to about 100 nm, from about 0.5 to about 50 nm, or from about 1 nm to about 100 nm. For example, the CNTs can have a length ranging from about 10 nm to about 5 mm, about 200 nm to about 10 microns, or about 500 nm to about 1 micron. For example, the CNTs can have an average surface area ranging from about 50 $m^2/g$ to about 3000 $m^2/g$, from about 50 $m^2/g$ to about 1500 $m^2/g$, or from about 500 $m^2/g$ to about 1000 $m^2/g$.

In some embodiments, the carbon nanotubes can be obtained in low and/or high purity dried paper forms or can be purchased in various solutions. In other embodiments, the carbon nanotubes can be available in the as-processed unpurified condition, where a purification process can be subsequently carried out.

The opto-thermal elements can include metal nanoshells. Exemplary metal nanoshells can include those disclosed in U.S. patent Ser. No. 12/257,015. The metal nanoshell can include a dielectric core and a metal shell disposed over the dielectric core. In some embodiments, the metal in the metal shell can be selected from the group consisting of gold, silver, and copper. In other embodiments, the dielectric core can be selected from the group consisting of silica, titania, and alumina. The dielectric core in the metal nanoshell can have a diameter from about 30 nm to about 150 nm and in some cases from about 50 nm to 70 nm with metal shell having a thickness from about 5 nm to about 25 nm and in some cases from about 10 nm to about 15 nm.

In embodiments, in addition to opto-thermal elements incorporated polymer, the opto-thermal toner can optionally include one or more colorants and optionally one or more waxes. Exemplary colorants and waxes can include those disclosed in U.S. patent Ser. No. 12/272,412. In one embodiment, the colorants can be carbon black and the waxes can be polyolefin waxes.

Various light sources can be used to provide the optical signal. For example, light sources can have an emission in the absorption range of the opto-thermal elements such that heat can be produced by light absorption of the opto-thermal elements from the light sources. Toner images containing opto-thermal elements can then be heated, fused, and/or fixed on the underlying surface.

In various embodiments, the light source(s) can include at least one of a UV lamp, a xenon lamp, a halogen lamp, a laser array, a light emitting diode (LED) array, and an organic light emitting diode (OLED) array. The light source can emit light anywhere from ultraviolet to near infrared region. In certain embodiments, the light source can be a digital light source, wherein each light component of the at least one of the laser array, the light emitting diode (LED) array, and the organic light emitting diode (OLED) array can be individually addressable. The term "light component" as used herein refers to an LED of the LED array, an OLED of the OLED array or a laser of the Laser array. The phrase "individually addressable" as used herein means that each light component such as an LED of the LED array can be identified and manipulated independently of its surrounding LEDs, for example, each LED or each group of LEDs can be individually turned on or off and output of each LED or each group of LEDs can be controlled individually. For example, in case of printing text with a certain line spacing and margins, the light components, such as for example one or more LEDs of the LED array corresponding to the text can be turned on to selectively expose light on those portions of the one or more opto-thermal elements that correspond to the text, but the LEDs corresponding to the line spacing between the text and the margins around the text can be turned off. Hence, with a digital light source, the opto-thermal elements can be a digital heat source.

The light source(s) can be selected according to the opto-thermal toner used for forming toner images, or vice versa. For example, depending on the power/intensity of the selected light sources, the imaging apparatus can have various configurations. FIGS. 2A-2B and 3A-3B depict exemplary apparatus and methods for forming images in accordance with various embodiments of the present teachings.

Figure 2A:
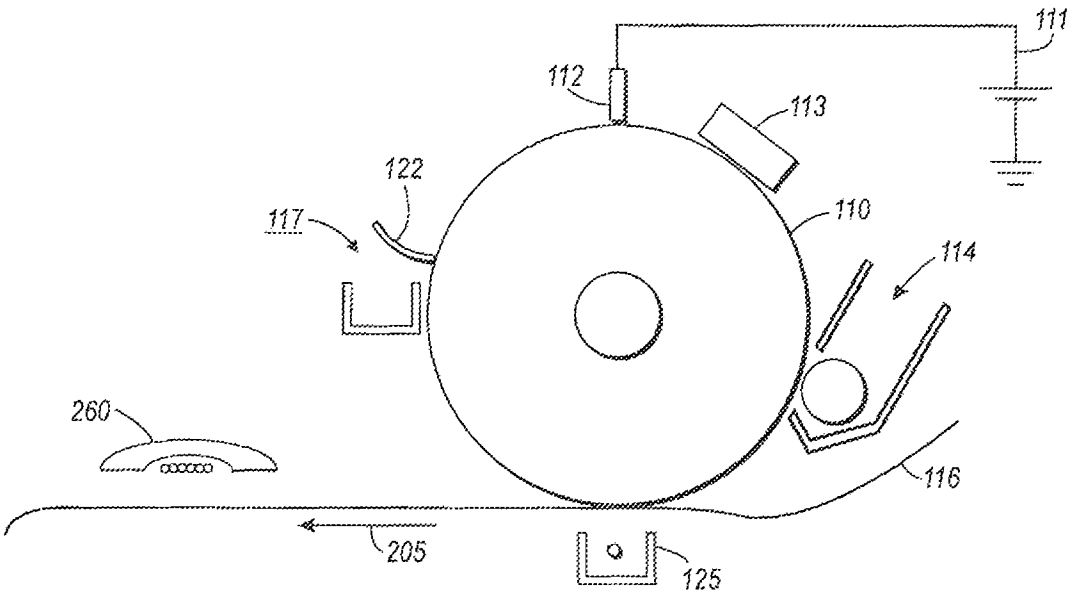
FIGS. 2A-2B depict an exemplary apparatus and method for forming an image in accordance with various embodiments of the present teachings.
Figure 2B:
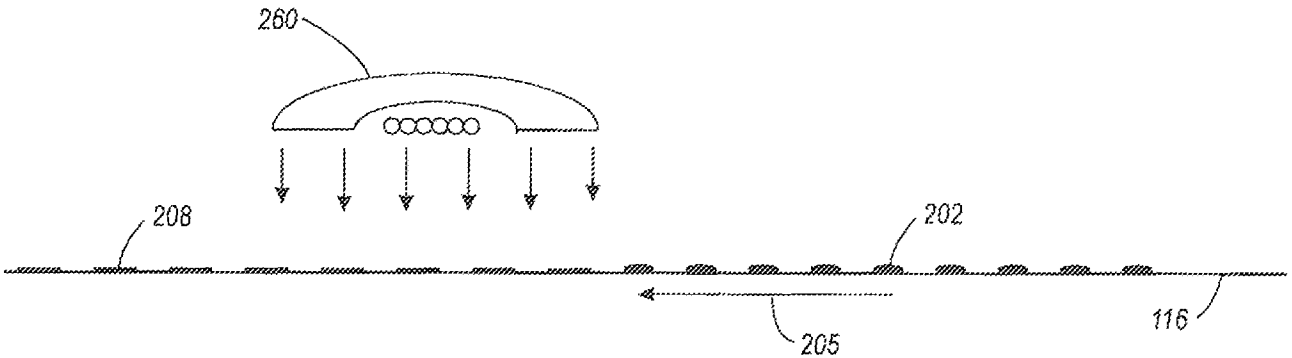

In FIGS. 2A-2B, the exemplary imaging apparatus 200A does not include a fuser subsystem as depicted in FIG. 1. Instead, one or more light sources 260 can be configured to fuse/fix toner images formed of an opto-thermal toner on the image receiving substrate 116. Specifically, as shown in FIG. 2A, toner images formed of the opto-thermal toner can be deposited on an image receiving member 110 and then transferred to the image receiving substrate 116 by an intermediate transfer member 125. As the image receiving substrate 116 having the toner images 202 thereon advances in the direction 205, the light source 260 can emit light to optically induce an opto-thermal effect of the opto-thermal elements contained in the toner images. Heat can then be generated due to this optically induced heating effect. The toner images 202 can then be heated, fused, and fixed on the imaging receiving substrate 116 to form fixed toner images 208 without using a fuser subsystem.

The light source(s) 260 can have a power and/or intensity sufficient to completely heat/fuse/fix the toner images on the image receiving substrate 116. For example, the light source (s) 260 can have a high power ranging from about 100 $mW/cm^2$ to about 50 $W/cm^2$, from about 500 $mW/cm^2$ to about 5 $W/cm^2$, or from about 5 $W/cm^2$ to about 50 $W/cm^2$. In this manner, by using light sources 260, a non-contact fusing/fixing of toner images 202 (see FIGS. 2A-2B) can be performed.

Figure 3A:
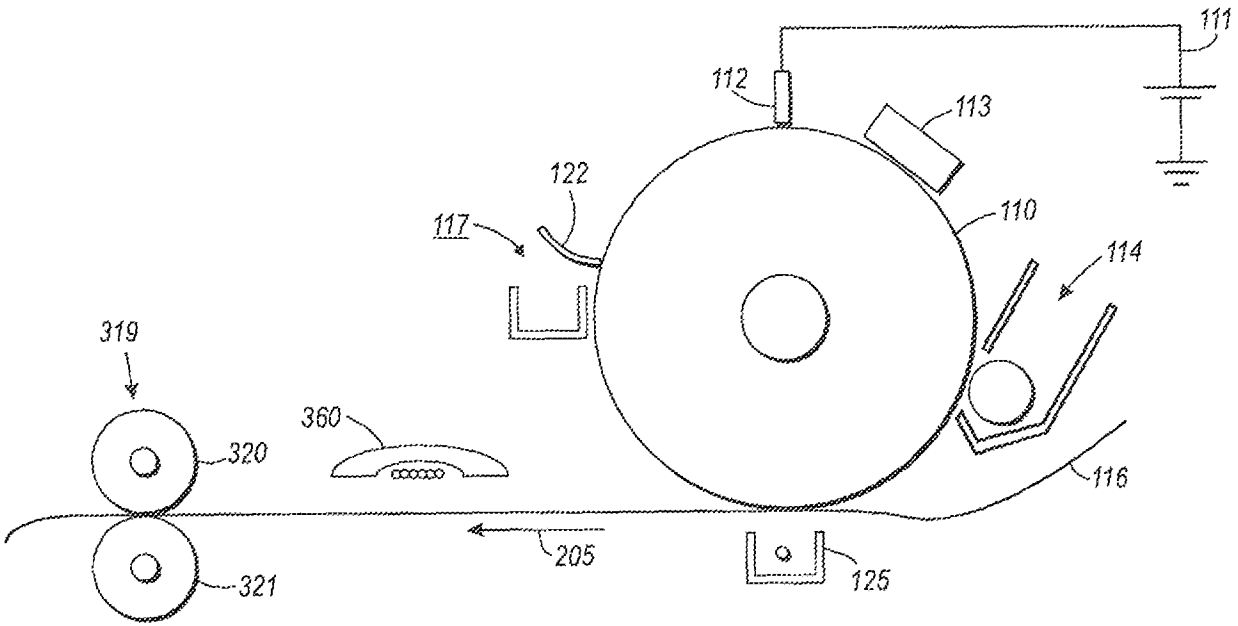
FIGS. 3A-3B depict another exemplary apparatus and method for forming an image in accordance with various embodiments of the present teachings.
Figure 3B:
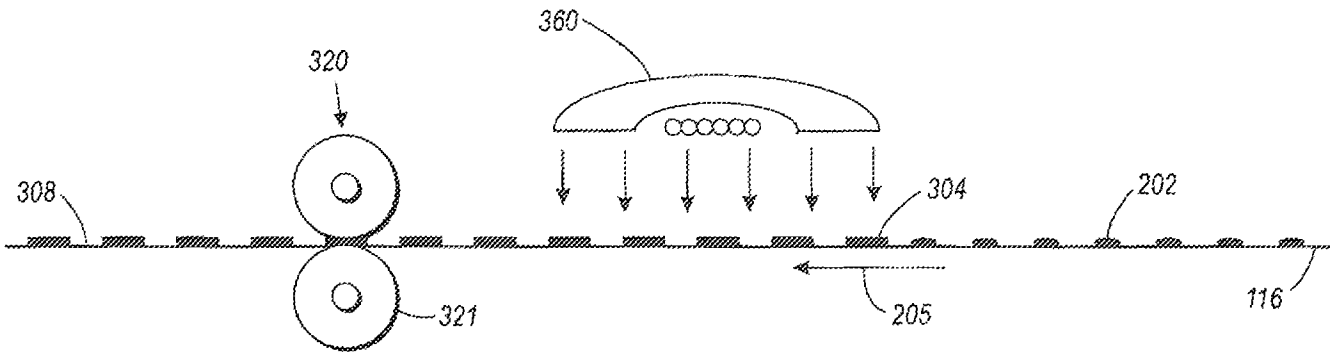

In FIGS. 3A-3B, the light source(s) 360 can be incorporated into a fuser subsystem for fusing/fixing toner images 202 formed of an opto-thermal toner. As shown, the light source(s) 360 can be used to pre-treat toner image 202 on the image receiving substrate 116 prior to passing the image receiving substrate 116 through a fuser subsystem 319. The pre-treatment can pre-heat or at least partially melt the toner image 202 to facilitate the subsequent fusing by the fuser subsystem 319. The fuser subsystem 319 can include a fuser member 320 and a backup or pressure member 321 configured as known to one of ordinary skill in the art. Each of the fuser member 320 and the pressure member 321 can be a roll member (see FIG. 3A), a belt member, and any possible combinations thereof as known in the art. The fuser member 320 and the pressure member 321 can cooperate to form a nip or contact arc through which the image receiving substrate 116, having pre-heated toner images 304 thereon, passes. Toner images 308 can then be fixed on the image receiving substrate 116.

Due to the pre-treatment by the light source(s) 360, the temperature and pressure required for fusing/fixing the toner images using the fuser subsystem can be significantly reduced as compared with conventional fuser subsystem. For example, conventional fusing process, without using the light source(s) 360, can be performed at a temperature ranging from about 60° C. (140° F.) to about 300° C. (572° F.). As compared, the disclosed fusing process by the fuser subsystem 319 can be performed at a temperature ranging from about 110° F. to about 450° F., from about 120° F. to about 400° F., or from about 130° F. to about 300° F. Optionally, a pressure can be applied during the fusing process by the backup or pressure member 321. For example, conventional fusing process can be performed at a pressure ranging from about 50 to about 150 Psi. As disclosed herein, the fusing process by the fuser subsystem 319 can be performed at a pressure ranging from about 20 Psi to about 130 Psi, from about 30 Psi to about 120 Psi, or from about 40 to about 110 Psi. Following the fusing process, the fused toner images 308 can be completely formed on the image receiving substrate 116.

In embodiments, the light source(s) 360 can have a power and/or intensity that may be lower than the light source(s) 260 depicted in FIGS. 2A-2B for pre-heating toner images. For example, the light source(s) 360 can have a low power ranging from about 0.01 W/cm$^2$ to about 10 W/cm$^2$, from about 0.05 W/cm$^2$ to about 5 W/cm$^2$, or from about 0.1 W/cm$^2$ to about 1 W/cm$^2$.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for forming an image comprising:

an image receiving member comprising a toner image deposited thereon, wherein the toner image comprises one or more opto-thermal elements incorporated with a polymer, the polymer being optically transparent having from about 10% to about 100% transparency in an absorption range of the one or more opto-thermal elements;

an intermediate transfer member for transferring the toner image from the image receiving member to an image receiving substrate; and one or more light sources configured in proximity to the toner image comprising the one or more opto-thermal elements to optically induce the one or more opto-thermal elements to heat the toner image on the image receiving substrate, wherein the one or more opto-thermal elements are selected from the group consisting of a carbon nanotube, graphene, a metal nanoshell, a metal nanostructure, and combinations thereof.

2. The apparatus of claim 1, wherein the apparatus does not include a fuser subsystem and the toner image is fused and fixed on the image receiving substrate by the one or more light sources.

3. The apparatus of claim 2, wherein the one or more light sources have a high power ranging from about 0.1 W/cm$^2$ to about 50 W/cm$^2$.

4. The apparatus of claim 1, further comprising a fuser subsystem for fusing and fixing the toner image that is heated by the one or more light sources on the image receiving substrate.

5. The apparatus of claim 4, wherein the one or more light sources have a low power ranging from about 0.01 W/cm$^2$ to about 10 W/cm$^2$.

6. The apparatus of claim 1, wherein the one or more opto-thermal elements comprise carbon nanotubes.

7. The apparatus of claim 1, wherein the one or more opto-thermal elements are present in an amount ranging from about 0.1% to about 60% by weight of the polymer.

8. The apparatus of claim 1, wherein the one or more opto-thermal elements are at least partially exposed to an optical signal provided by the one or more light sources.

9. The apparatus of claim 1, wherein the polymer is a polycarbonate, polyamide, polyester, polyurethane, polyethylene, polyolefin, latex polymer, or a mixture thereof.

10. The apparatus of claim 1, wherein the optically transparent polymer comprises at least one of polycarbonate, PET, PMMA, nanocomposite polymers or conducting polymers comprising polythiophene and polyaniline and its derivatives.

11. The apparatus of claim 1, wherein each of the one or more light sources comprises one or more of a UV lamp, a xenon lamp, a halogen lamp, a laser array, a light emitting diode array, or an organic light emitting diode array.

12. The apparatus of claim 1, wherein each of the one or more opto-thermal elements comprises a nanoparticle having an average particle size ranging from about <1 nm to about 500 nm.

13. A method of forming an image comprising:

incorporating one or more opto-thermal elements into a toner composition to form an opto-thermal toner, wherein the one or more opto-thermal elements are selected from the group consisting of a carbon nanotube, graphene, a metal nanoshell, a metal nanostructure, and combinations thereof;

depositing the opto-thermal toner on an image receiving member to form a toner image;

transferring the toner image from the image receiving member to an image receiving substrate; and exposing the one or more opto-thermal elements in the toner image to an optical signal to generate heat to fix the toner image on the image receiving substrate, wherein the step of exposing the one or more opto-thermal elements to an optical signal to generate heat comprises heating the opto-thermal elements to a temperature ranging from about 50° C. to about 1500° C.

14. The method of claim 13, wherein the optical signal is provided by one or more light source having a high power ranging from about 0.1 $W/cm^2$ to about 50 $W/cm^2$.

15. A method of forming an image comprising:

depositing a toner image on an image receiving member; the toner image comprising one or more opto-thermal elements selected from the group consisting of a carbon nanotube, graphene, a metal nanoshell, a metal nanostructure, and combinations thereof;

transferring the toner image from the image receiving member to an image receiving substrate;

exposing the one or more opto-thermal elements in the toner image to an optical signal to heat the toner image on the image receiving substrate; and passing the image receiving substrate through a contact arc formed by a fuser member and a pressure member to fix the toner image on the image receiving substrate, wherein the step of exposing the one or more opto-thermal elements to an optical signal comprises heating the opto-thermal elements to a temperature ranging from about 50° C. to about 1500° C.

16. The method of claim 15, further comprising fusing the toner image at a temperature ranging from about 110° F. to about 450° F. by the fuser member and the pressure member.

17. The method of claim 15, further comprising fusing the toner image at a pressure ranging from about 20 Psi to about 130 Psi by the fuser member and the pressure member.

18. The method of claim 15, wherein the optical signal is provided by one or more light source having a low power ranging from about 0.01 $W/cm^2$ to about 10 $W/cm^2$.

19. The method of claim 13, wherein the one or more opto-thermal elements comprise carbon nanotubes.

20. The method of claim 15, wherein the one or more opto-thermal elements comprise carbon nanotubes.

* * * * *